US010240331B1

(12) United States Patent
Condon et al.

(10) Patent No.: US 10,240,331 B1
(45) Date of Patent: Mar. 26, 2019

(54) WATER CLOSET FLANGE INSERT

(71) Applicant: LSP Products Group, Inc., Irving, TX (US)

(72) Inventors: Duane R. Condon, Ramona, CA (US); Daniel I. South, Dayton, NV (US); William A. Ghiglieri, Reno, NV (US)

(73) Assignee: LSP Products Group, Inc., Irving, TX (US)

( * ) Notice: Subject to any disclaimer, the term of this patent is extended or adjusted under 35 U.S.C. 154(b) by 0 days.

(21) Appl. No.: 15/652,877

(22) Filed: Jul. 18, 2017

Related U.S. Application Data

(60) Provisional application No. 62/364,448, filed on Jul. 20, 2016.

(51) Int. Cl.
*E03D 11/16* (2006.01)

(52) U.S. Cl.
CPC ..... *E03D 11/16* (2013.01)

(58) Field of Classification Search
CPC ..... Y10T 403/645; Y10T 403/642; Y10T 403/64; F16B 21/09
USPC ..... 4/252.4, 429; 248/229.12, 229.22; 411/129, 85
See application file for complete search history.

(56) References Cited

U.S. PATENT DOCUMENTS 175,133 A * 3/1876 Miller ..... F16B 39/24 411/131
3,669,171 A * 6/1972 Yavitch ..... E03D 11/16 285/58
4,470,716 A * 9/1984 Welch ..... F16B 12/38 248/221.12
8,561,218 B1 * 10/2013 Arce ..... E03D 11/16 4/252.4

* cited by examiner

*Primary Examiner* — Lauren Crane
(74) *Attorney, Agent, or Firm* — Thomas Horstemeyer, LLP

(57) ABSTRACT

Disclosed are various embodiments for an insert apparatus for a water closet flange. The insert apparatus has an elevated arcuate portion that extends from a first end to a second end, the elevated portion comprising an arcuate keyhole aperture through the insert apparatus, the arcuate keyhole aperture having an eyelet end and a narrowed length; a raised edge positioned along at least a portion of a perimeter of the narrowed length of the arcuate keyhole aperture; a first recessed portion that extends away from the first end of the elevated arcuate portion and a second recessed step that extends away from the second end of the elevated portion; a first clip integral with the insert apparatus extends substantially perpendicular to a plane associated with the arcuate keyhole aperture; and a second clip integral with the insert apparatus extends substantially perpendicular to the plane associated with the arcuate keyhole aperture.

19 Claims, 11 Drawing Sheets

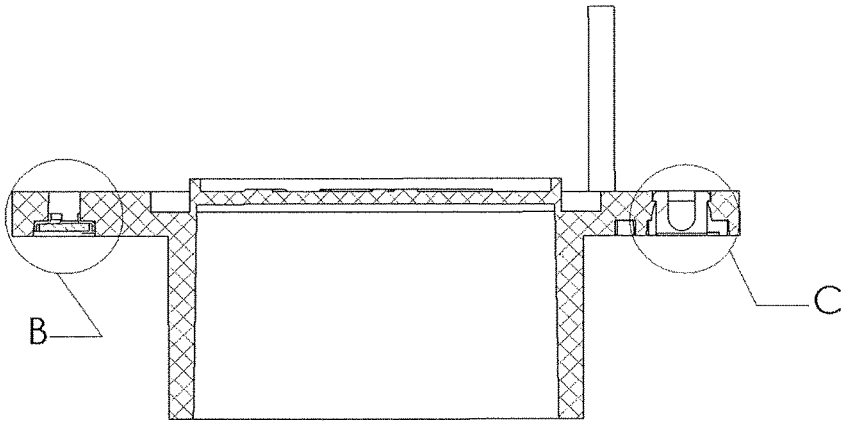
FIG. 3B
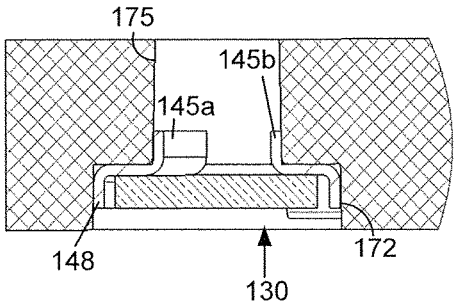
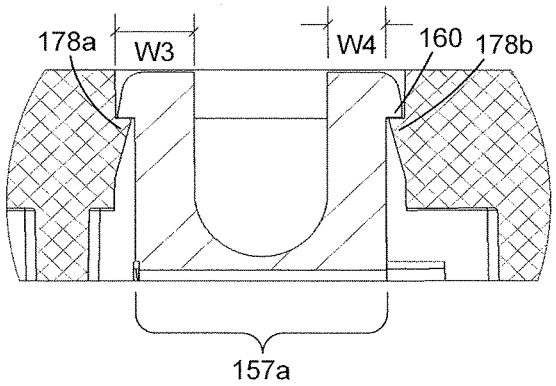
FIG. 3C
FIG. 3D

WATER CLOSET FLANGE INSERT

CROSS REFERENCE TO RELATED APPLICATIONS

This application claims the benefit of, and priority to, U.S. Provisional Patent Application No. 62/364,448 entitled "WATER CLOSET FLANGE INSERT" filed on Jul. 20, 2016, which is incorporated herein by reference in its entirety.

BACKGROUND

A water closet flange is used to mount a toilet to the floor and connects a toilet drain to a drain pipe in the floor. In particular, the toilet is bolted to the water closet flange and the water closet flange is connected to the floor surrounding the drain pipe.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIGS. 3A-3D illustrate a top view and cross section views of the water closet flange assembly shown in FIGS. 1A and 1B according to one embodiment described herein.

Figure 1A:
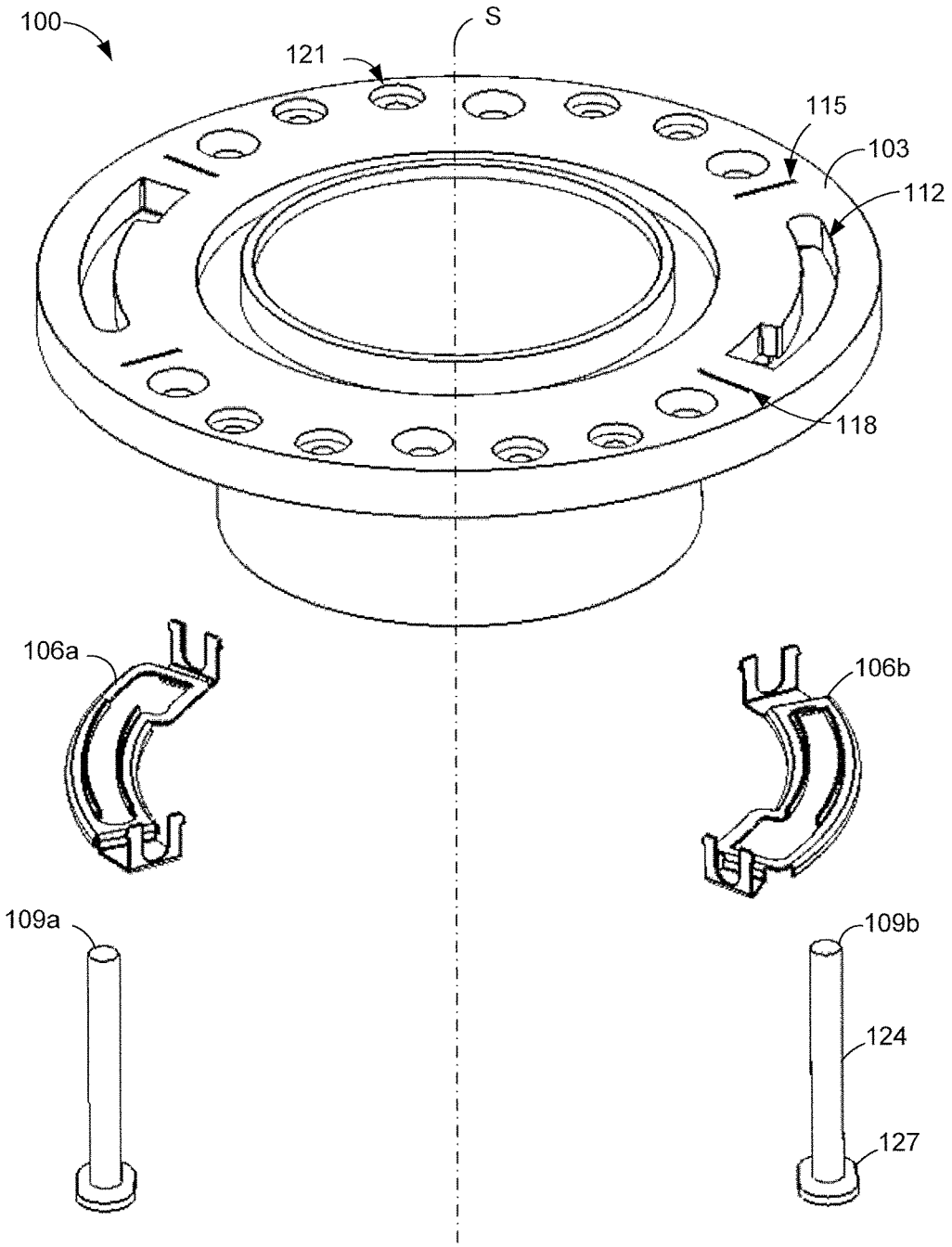
FIGS. 1A and 1B illustrate exploded views of a water closet flange assembly according to one embodiment described herein.

The drawings illustrate only exemplary embodiments and are therefore not to be considered limiting of the scope of the embodiments described herein, as other equally effective embodiments are within the scope and spirit of this disclosure. The elements and features shown in the drawings are not necessarily drawn to scale, emphasis instead being placed upon clearly illustrating the principles of the exemplary embodiments. Additionally, certain dimensions or positionings may be exaggerated to help visually convey certain principles. In the drawings, similar reference numerals between figures designates like or corresponding, but not necessarily identical, elements.

DETAILED DESCRIPTION

Typically, a water closet flange is used to mount a toilet to the floor. The water closet flange connects a toilet drain to a drain pipe in the floor. During installation, the water closet flange is positioned on top of the drain pipe. In some installations, the water closet flange can be attached to the floor surrounding the drain pipe by inserting screws through apertures positioned along the perimeter of the water closet flange and drilling the screws into the floor surface.

The toilet can then be secured to the water closet flange. A shaft of a bolt is inserted in an elongated aperture positioned along the perimeter of the water closet flange. The elongated aperture may be arcuate in shape. A base of the bolt is larger in diameter than a narrowed portion of the elongated aperture. Thus, the bolt cannot pass entirely through the narrowed portion of the elongated aperture. The toilet is positioned on top of the water closet flange such that the bolt shaft is inserted through elongated aperture positioned at the base of the toilet. A nut is placed at the top of the bolt and turned to tighten the nut against the toilet base. As the nut is turned about the bolt, the nut and the bolt are attached via a threaded engagement. In addition, as the nut is turned, the nut is pulled toward the base of the bolt, which secures the toilet base between the nut and the water closet flange. Accordingly, an individual can turn the nut to an appropriate degree to secure the toilet base between the nut and the water closet flange.

However, the bolt attachment may lack rigidity or strength and as a result the toilet may be dislodged from the water closet flange or the flange could break. The lack of rigidity can be caused from various issues, such as the materials used to construct the water closet flange. For example, plastic flanges do not always have the necessary strength and some stainless steel flanges can corrode over time. In this context, the present disclosure relates to an insert that provides rigidity for the bolt attachment of the water closet flange to the toilet. Specifically, the embodiments relate to the insert being attached to a bottom side of a water closet flange. The water closet flange has a recessed area surrounding the elongated aperture on the bottom side. The insert fits within the recessed area. In addition, when attached within the recessed area, the elongated aperture substantially aligns with a keyhole aperture associated with the insert. The elongated aperture and the keyhole aperture can be arcuate in shape. Accordingly, when the bolt shaft is inserted through the elongated aperture, it can also extend through the keyhole aperture associated with the insert. The structure and the material composition of the insert provide additional strength to the bolt attachment. Thus, the toilet base is provided additional rigidity with the water closet flange.

Turning to the drawings, a general description of embodiments of an insert for a water closet flange and its components is provided, followed by a discussion of the operation of the same. With reference to FIG. 1A, an exploded view of a water closet flange assembly 100 is shown. The water closet flange assembly 100 includes a water closet flange 103 situated above a first insert 106*a* and a second insert 106*b* (collectively "inserts 106") with respect to a center axis "S." The inserts 106 are positioned above a first bolt

109*a* and a second bolt 109*b* (collectively "bolts 109") with respect to the center axis "S".

The water closet flange 103 includes a flange aperture 112 positioned along a perimeter of the water closet flange 103. As shown in FIG. 1A, the flange aperture 112 is positioned between a first clip slot 115 and a second clip slot 118. The first clip slot 115 and the second clip slot 118 extend radially away from the center axis "S." The first clip slot 115 and the second clip slot 118 are representative of a plurality of clip slots that can be positioned along the perimeter of the water closet flange 103. The flange aperture 112 is representative of multiple apertures that can be positioned along the perimeter of the water closet flange 103. The flange aperture 112 can be arcuate and elongated in shape. In addition, the water closet flange shown in FIG. 1A includes a plurality of perimeter apertures 121.

Each of the bolts 109 includes a bolt shaft 124 and a bolt base or head 127. In some embodiments, the bolt shaft 124 may include a threaded length and the bolt base 127 may have a diameter or be otherwise sized larger than a portion of the flange aperture 112.

The water closet flange assembly 100 has several advantages over existing solutions. As indicated above, the attachment of the water closet flange 103 to the base of a toilet may be easier and provide additional rigidity and strength. The material composition of the insert 106 provides additional strength to an area surrounding with flange aperture 112 of the water closet flange 103. In addition, the structure of the insert 106 provides additional support.

Figure 1B:
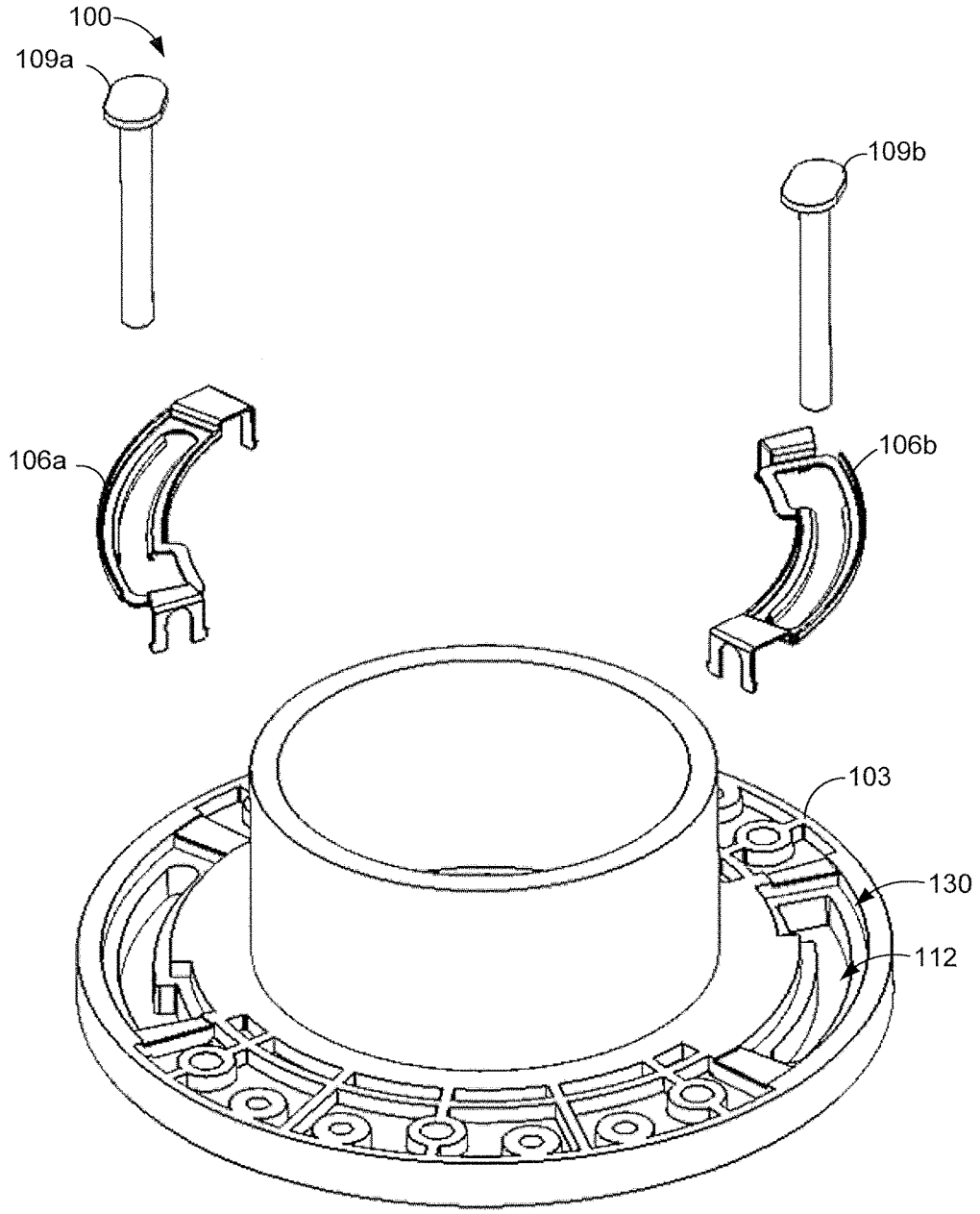

Referring next to FIG. 1B, shown is an exploded bottom side view of the water closet flange assembly 100. As shown, a bottom side of the water close flange 103 includes a recessed area 130 surrounding the flange aperture 112.

The water closet flange assembly 100 can be assembled by an individual by aligning one or more clips (FIGS. 2A and 2B) of the insert 106 with the clip slots 115 and 118 on the bottom side of the water closet flange 103. While the clips are aligned, the insert 106 can be pushed into the recessed area 130. As the clips are pushed into the clip slots 115 and 118, the clips are engaged to attach to portions of the water closet flange 103 within the clip slots 115 and 118. When attached, a keyhole aperture (FIG. 2) of the insert 106 substantially aligns with the flange aperture 112. The bolt shaft 124 can be inserted through an eyelet end (FIG. 2) of the keyhole aperture, which also enables the bolt to extend through a flange eyelet end (FIG. 3). The bolt 109 can be moved to a narrowed length of the insert 106 and the water closet flange 103.

Figure 2A:
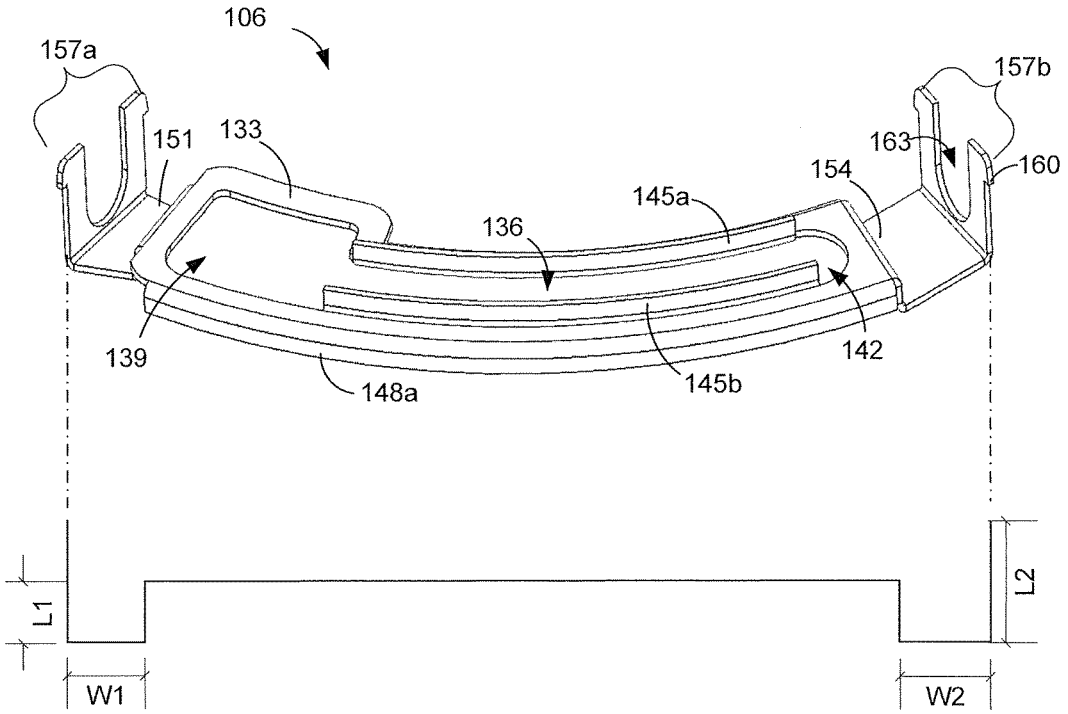
FIGS. 2A and 2B illustrate perspective views of an insert associated with the water closet flange assembly shown in FIGS. 1A and 1B according to one embodiment described herein.

Turning to FIG. 2A, a perspective top side view of the insert 106 is shown. The insert 106 may include an elevated portion 133 that extends from a first end to a second end. In some embodiments, the elevated portion 133 has an arcuate shape. The elevated portion 133 includes a keyhole aperture 136 which is arcuate in shape and comprises an eyelet end 139 and a narrowed length 142. The elevated portion 133 also includes a first raised edge 145*a* and a second raised edge 145*b* positioned along a perimeter of the narrowed length 142 of the arcuate keyhole aperture 136. In addition, the elevated portion 133 includes a first lowered edge 148*a* and a second lowered edge 148*b* (FIG. 2B) positioned along a perimeter of the elevated portion 133. In particular, FIG. 2B shows the first lowered edge 148*a* and the second lowered edge 148*b*.

Figure 2B:
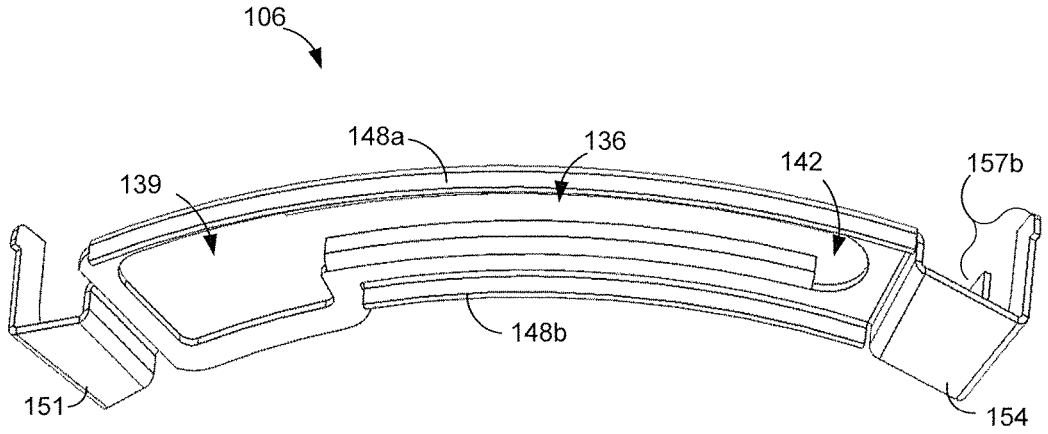

Referring between FIGS. 2A and 2B, the insert 106 also includes a first recessed portion 151 that extends away from the first end of the elevated portion 133 and a second recessed portion 154 that extends away from the second end of the elevated portion 133. The first recessed portion 151 and the second recessed portion 154 extend below a plane associated with the arcuate keyhole aperture 136. The recessed portions 151 and 154 can prevent the insert 106 from moving along the perimeter of the water closet flange 103. In addition, as illustrated in FIG. 2A, the first recessed portion 151 and the second recessed portion 154 have a length "L1" that represents the length from the recess portion to the elevated portion 133. In some embodiments, the length of the first recessed portion 151 may be different from the length of the second recessed portion 154.

The insert 106 can also comprise a first clip 157*a* and a second clip 157*b* (collectively "clips 157") integral to the insert 106 that extend substantially perpendicular to a plane associated with the keyhole aperture 136. The first clip 157*a* and the second clip 157*b* may have a length "L2" that represents the length from the first recessed portion 151 or the second recessed portion 154 to a top of the clip 157. In some embodiments, the clips 157 can have two spaced-apart segments. Each spaced-apart segment may comprise a detent tooth 160 at a distal end away from the first recessed portion 151 or the second recessed portion 154. As shown, the first clip 157*a* and the second clip 157*b* have a U-shaped configuration 163. Additionally, the first recessed portion 151 has a width "W1" and the second recessed portion 154 has a width "W2." In some embodiments, the insert 106 may comprise one, two, or even no clips 157. In addition, in some embodiments, the insert 106 may comprise one or no recessed steps.

The insert 106 can be attached to the water closet flange 103 (FIG. 1A) by aligning the clips 157 with the clip slots 115 and 118 on the bottom side of the water closet flange 103. While aligned, the clips 157 can be pushed into the clip slots 115 and 118. Each detent tooth 160 can engage with one of the flange detent teeth within the clip slots. The engagement enables the clips 157 to attach within the clip slots 115 and 118 and prevents the clips from being dislodged. Accordingly, the clips 157, when attached, can prevent the insert 106 from being removed from the recessed area 130.

Figure 3A:
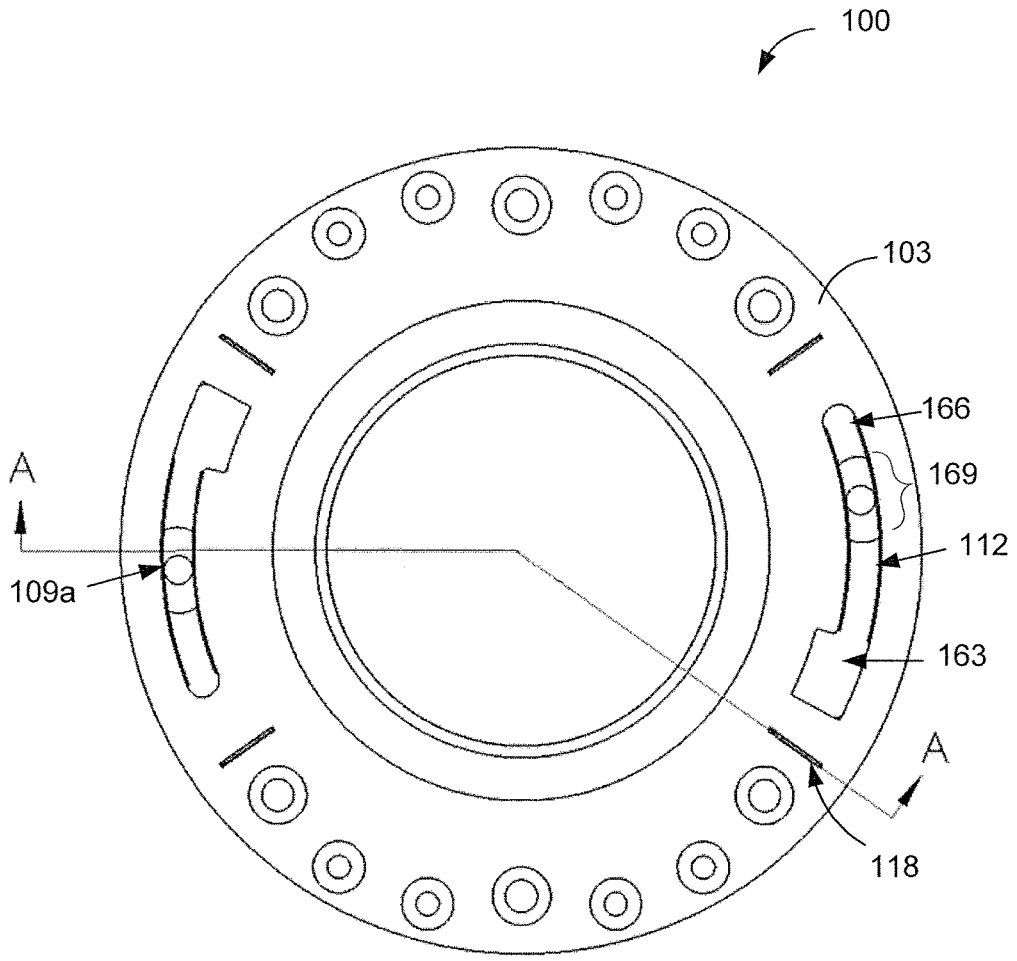

Turning now to FIG. 3A, shown is a top side view of the water closet flange assembly 100. In particular, the illustrated embodiment shows a top view of the bolts 109 extended through the flange apertures 112. Although not shown, the insert 106 is attached to a bottom side of the water closet flange 103. According, the bolt 109*a* is extended through the keyhole aperture 136 and the flange aperture 112. As shown in FIG. 3A, the flange aperture 112 comprises a flange eyelet end 163 and a flange narrowed length 166. The bolt base 127 is shown to have a base diameter 169 larger than a width of the flange narrowed length 166 and the narrowed length 142 of the insert 106.

As a non-limiting example, an individual can insert the bolt shaft 124 through the eyelet end 139 of the insert 106 and the flange eyelet end 163. The bolt 109 can be moved to the flange narrowed length 166. As such, the bolt 109 is prevented from passing through the flange narrowed length 166 and the narrowed length 142 of the insert 106 as a result of the bolt base 127. Additionally, the illustrated embodiment displays a cross sectional "AA" reference for FIGS. 3B, 3C, and 3D. In FIG. 3A, the arrows associated with the "AA" reference provide an indication of the direction of the cross sectional view for FIGS. 3B, 3C, and 3D.

Referring now to FIG. 3B, shown is a cross sectional view of the water closet flange assembly 100 designated "AA" in FIG. 3A. Further, FIG. 3B indicates an enlargement "B" reference of a portion of the flange aperture 112 with the insert 106 attached as shown in FIG. 3C. FIG. 3B also indicates an enlargement "C" reference of a different portion of the flange aperture 112 with the insert 106 attached as shown in FIG. 3D.

Moving on to FIG. 3C, shown is an enlarged cross sectional view of a portion of the flange arcuate aperture 112 with the insert 106 attached. In particular, FIG. 3C shows a portion of the flange narrowed length 166. In addition, the illustrated embodiment shows the insert 106 within the recessed area 130 of the water closet flange 103.

As shown in the FIG. 3C, the recessed area 130 can comprise a first tier 172 and a second tier 175. In some embodiments, among other, the first tier 172 can come in contact with one or both of the lowered edges 148*a* and 148*b* of the insert 106. The second tier 175 can come in contact with one or both of the raised edges 145*a* and 145*b*.

Turning to FIG. 3D, shown is an enlarged cross sectional view of a portion of the second clip slot 118 (FIGS. 1A and 3A) with the insert 106 attached. In particular, the illustrated embodiment displays the second clip 157*a* of the insert 106 in the second clip slot 118.

As shown in FIG. 3D, the second clip slot 118 may include a slot detent tooth 178 that can engage with the detent tooth 160 of the insert 106. In some embodiments, the engagement enables the second clip 157*a* to attach to the bottom side of the water closet flange 103. The first clip slot 115 and the clip slots can include similar features.

In addition, the illustrated embodiment displays an enlarged view of the second clip 157*a*. Specifically, FIG. 3D illustrates the detent tooth 160 having a width "W3" at a distal end of each of the two spaced-apart segments. Each of the spaced-apart segments also comprises a width "W4," which is less than the W3 as shown in FIG. 3D.

As one non-limiting example of the operation, an individual can attach the insert 106 by aligning the clips 157 with the clip slots 115 and 118 on the bottom side of the water closet flange 103. With the clips 157 aligned, the individual can attach the insert 106 by pushing the insert 106 into the recessed area 130. In some embodiments, the two spaced-apart segments of the clips 157 can bend inward toward each other to enable the distal ends of the segments to fit within a narrowed gap formed by a first slot detent tooth 178*a* and a second slot detent tooth 178*b* (collectively "slot detent teeth 178"). After passing the narrowed nap, the two spaced-apart segments can bend away from each other in an outward direction. As a result, the detent tooth 160 of the insert 106 is engaged with the slot detent teeth 178. The engagement prevents the clips 157 from being dislodged from the clip slots 118 and 115, which in turn prevents the insert 106 from being dislodged from the recessed area 130.

Figure 4A:
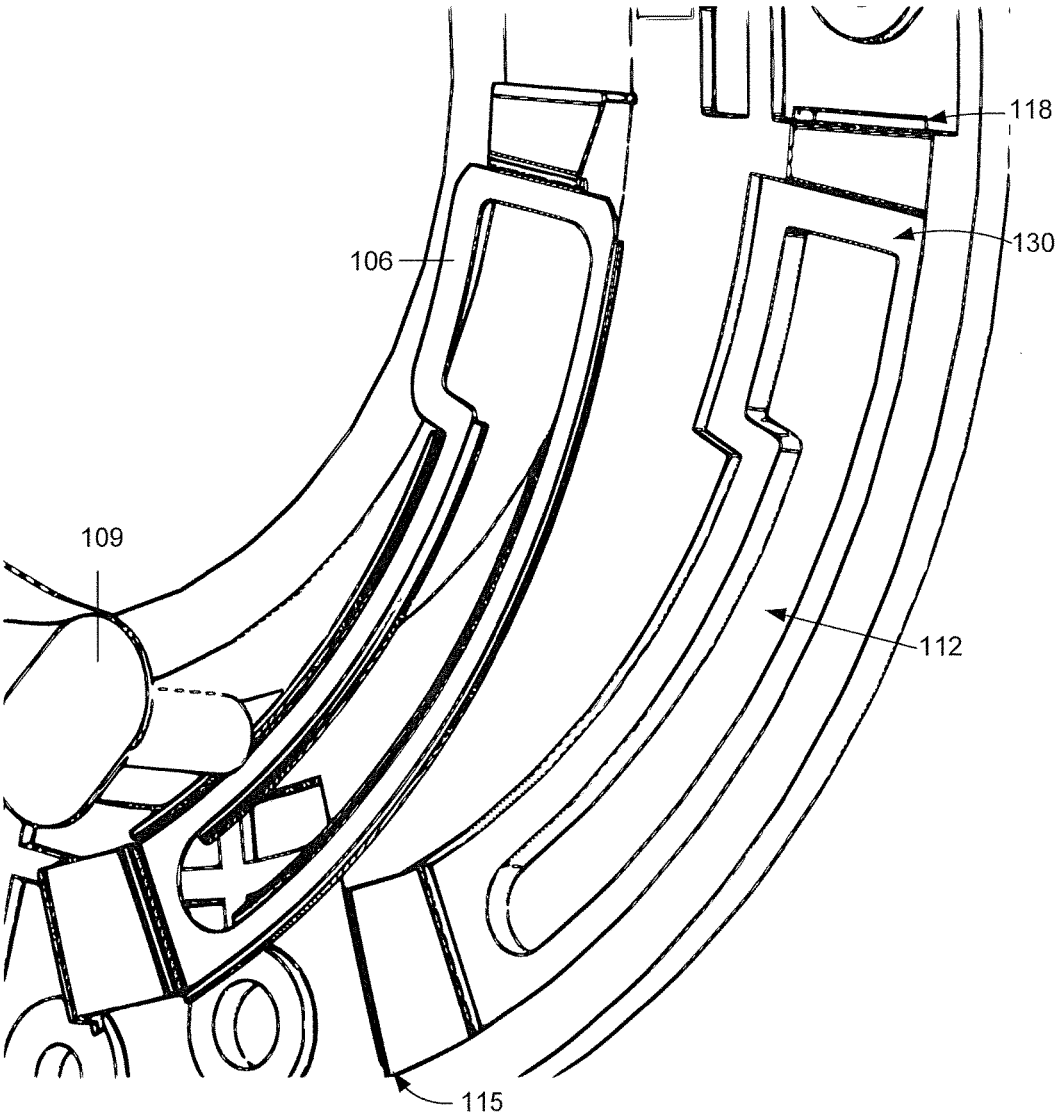
FIGS. 4A and 4B illustrate enlarged exploded views of the bolt, the insert, and a bottom side of the water closet flange according to one embodiment described herein.

With reference to FIG. 4A, an enlarged exploded bottom side view of the water closet flange assembly 100 is shown. Specifically, FIG. 4A illustrates an enlarged viewed of the recessed area 130 of the water closet flange 103 and a bottom side view of the insert 106*b* and the bolt 109*b*.

Figure 4B:
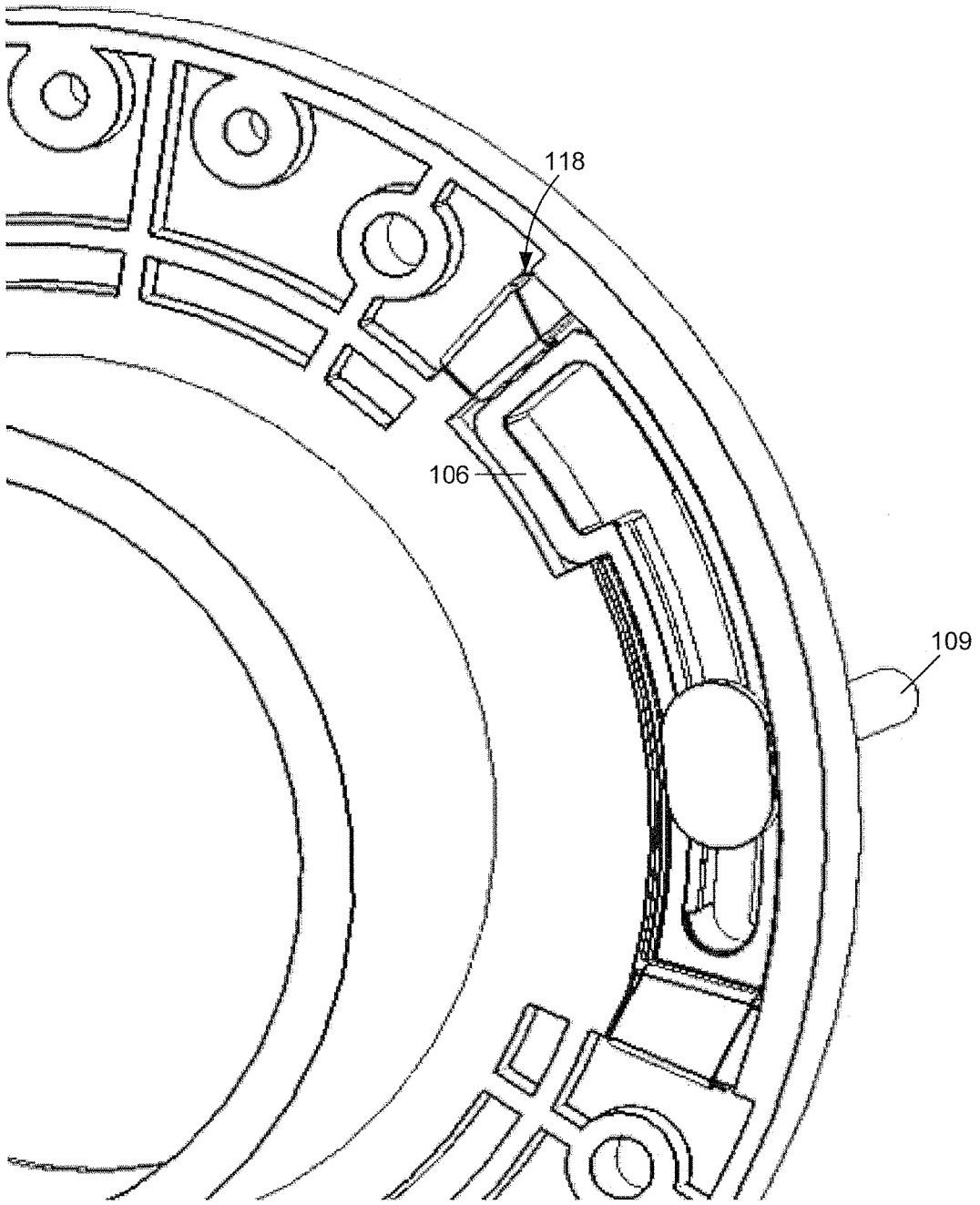

Moving on to FIG. 4B, shown is an enlarged bottom side view of the water closet flange assembly 100. In particular, FIG. 4B illustrates a bottom side view of the insert 106 attached to the water closet flange 103 within the recessed area.

Figure 5A:
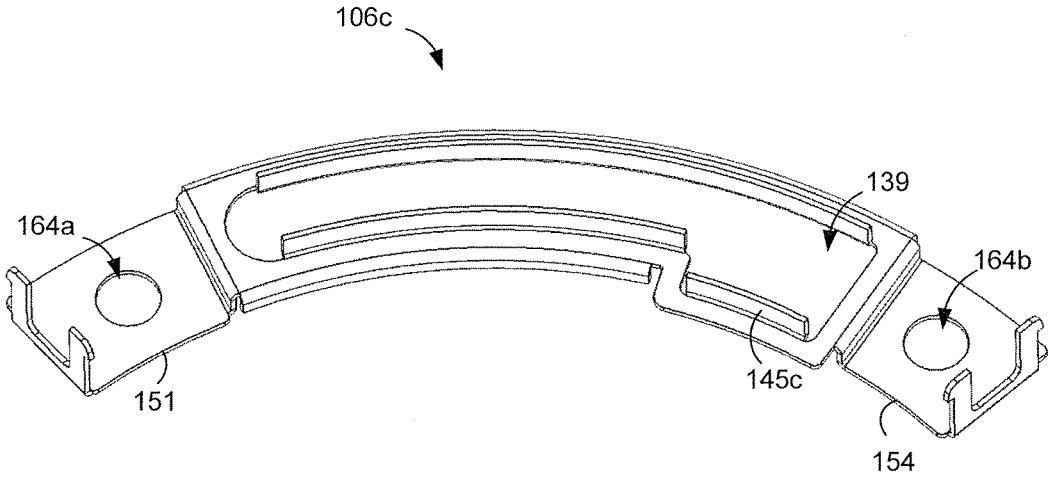
FIG. 5A illustrates a perspective view of an alternative insert embodiment to the insert shown in FIGS. 2A and 2B according to one embodiment described herein.
Figure 5B:
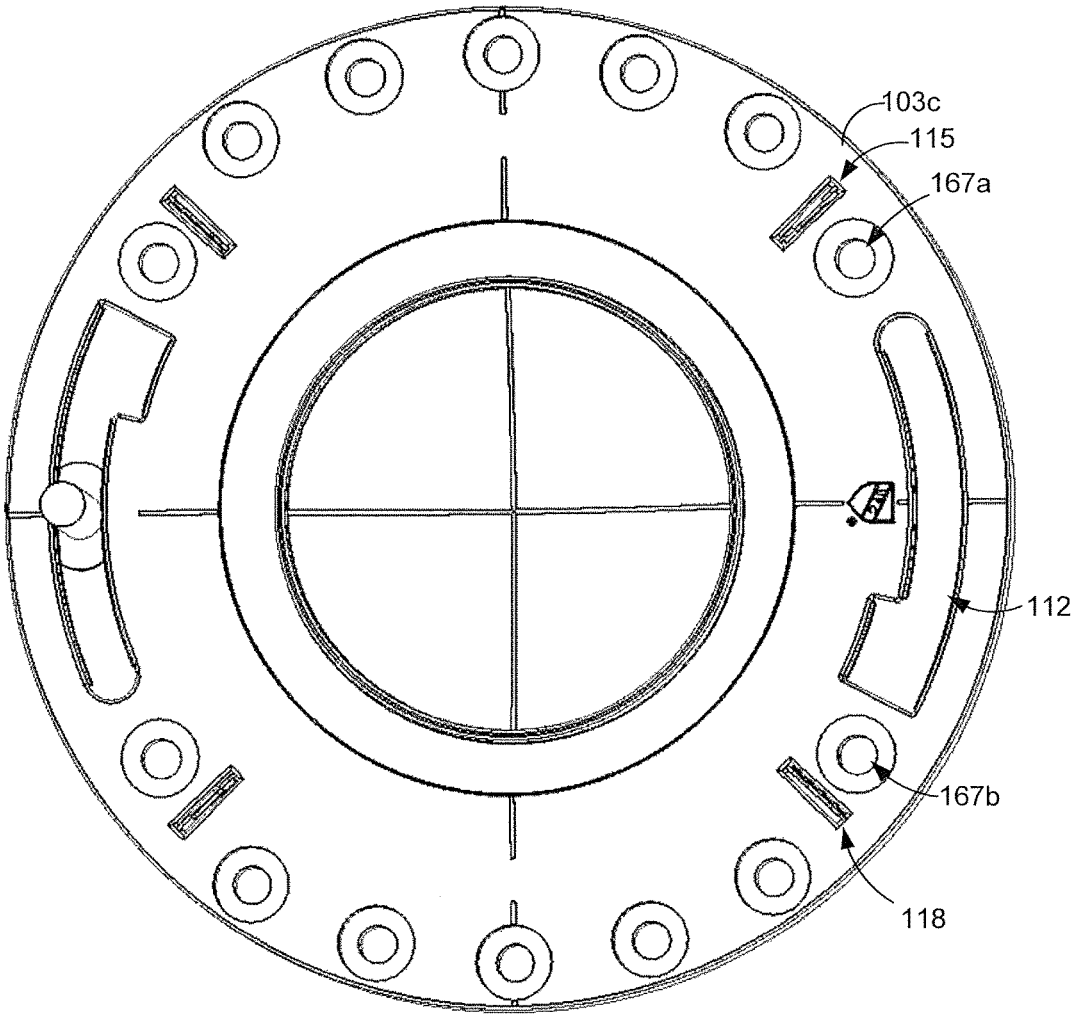
FIG. 5B illustrates a top view of an alternative water closet flange for the alternative insert shown in FIG. 5A according to one embodiment described herein.

Referring now to FIG. 5A, shown is a perspective view of an insert 106*c*, which is an alternative embodiment of the insert 106. The insert 106*c* may include a first recessed aperture 164*a* in the first recessed portion 151 and a second recessed aperture 164*b* (collectively "recessed apertures 164") in the second recessed portion 154. The insert 106*c* may also include a third raised edge 145*c* along a portion of the eyelet end 139. The insert 106*c* is attached to a water closet flange 103*c* (FIG. 5B) with perimeter apertures that correspond to the first recessed aperture 164*a* and the second recessed aperture 164*b*. Specifically, FIG. 5B shows a first insert aperture 167*a* and a second insert aperture 167*b* (collectively "insert apertures 167"). The insert apertures 167 are positioned along the perimeter of the water closet flange 103*c*. In some embodiments, as shown in FIG. 5B, each insert aperture 167 can be positioned between either the first clip slot 115 or the second clip slot 118 and the flange aperture 112.

Referring between FIGS. 5A and 5B, the illustrated embodiment depicts an example of securing the insert 106*c* and the water closet flange 103*c* to the floor around a drain pipe. Similar to the embodiments discussed above, the insert 106*c* is aligned and attached to the water closet flange 103*c*. When attached, the recessed apertures 164 are aligned with the first insert aperture 167*a* and the second insert aperture 167*b*. Mechanical fasteners, such as screws or rivets, can be inserted into and through the insert apertures 167 and the recessed apertures 164. The fasteners can be attached to the floor surrounding the drain hole. In this embodiment, the recessed apertures 164 provide an additional mechanism that prevents the insert 106*c* from being dislodged.

Figure 6B:
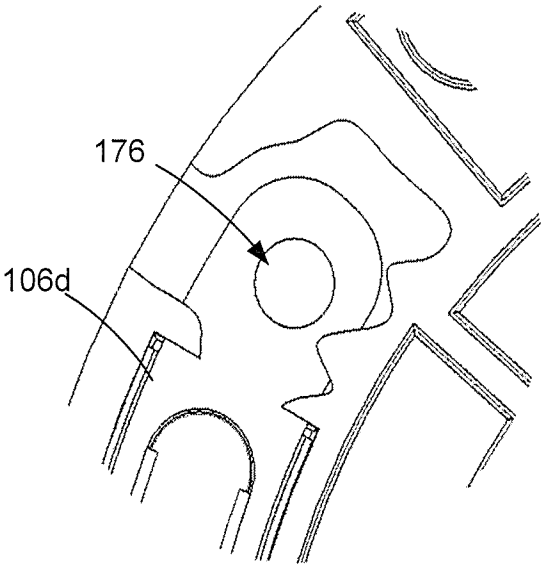
FIG. 6B illustrates an enlarged view of the over-molded insert shown in FIG. 6A according to one embodiment described herein.
Figure 6A:
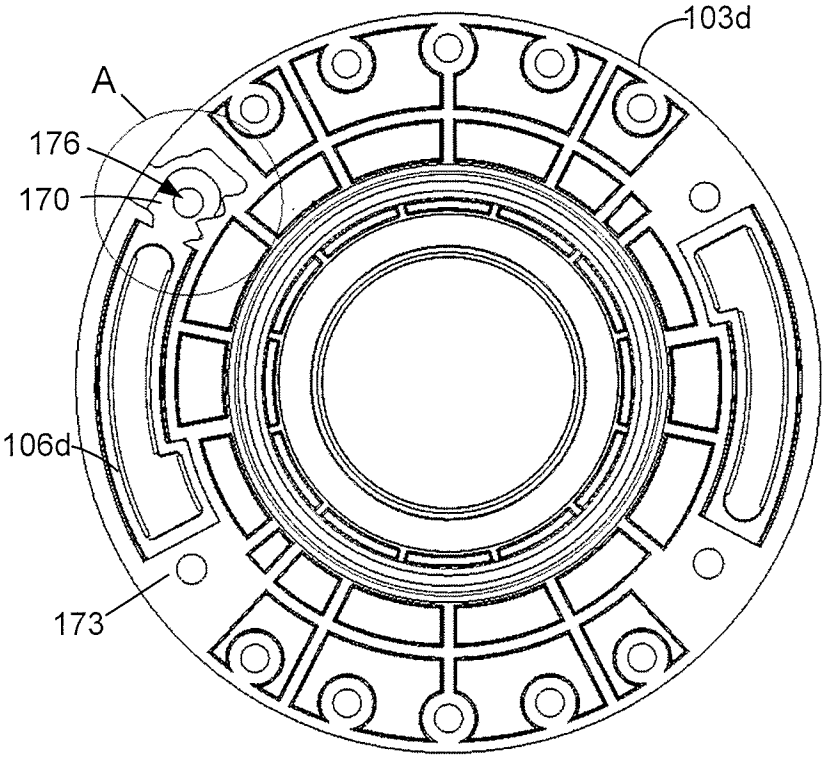
FIG. 6A illustrates a bottom side view of an alternative water closet flange with an over-molded insert embedded within according to one embodiment described herein.

Referring now to FIG. 6A, shown is a bottom side view of an over-molded embodiment. Specifically, FIG. 6A illustrates a bottom side view of a water closet flange 103*d* with an insert 106*d* embedded within by an over-molded process. The insert 106*d* has a first end 170 and a second end 173. At the first end 170 and the second end 173, the insert 106*d* can have a tab aperture 176. FIG. 6A illustrates a cut-away view of the first end 170 and depicts an "A" reference for an enlarged view in FIG. 6B. FIG. 6B illustrates that the insert 106*d* is truncated in comparison to previously discussed embodiments. For instance, the illustrated embodiment does not include clips and recessed steps as one non-limiting example.

Referring between FIGS. 6A and 6B, the insert 106*d* can be inserted within a recessed area within the bottom side of the water closet flange 103*d*, similar to other embodiments discussed above. During the insertion, the insert 106*d* can be positioned to align the tab aperture 173 with the insert aperture 167. Subsequently, a mold plastic material can be injected into the water closet flange 103*d* in areas substantially near the first end 170 and/or the second 173 of the insert 106*d*. The mold plastic material can be configured to substantially embed the insert 106*d* within the water closet flange 103*d* without obstructing the insert aperture 167 and the tab aperture 176. Thus, a user can insert a mechanical fastener into and through the insert aperture 167 and the tab aperture 176 to secure the water closet flange 103*d* and the insert 106*d* to the floor surround the drain hole.

Figure 7B:
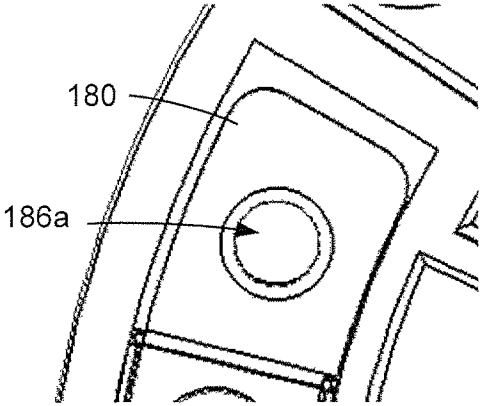
FIG. 7B illustrates an enlarged view of the pressed-in insert shown in FIG. 7A according to one embodiment described herein.
Figure 7A:
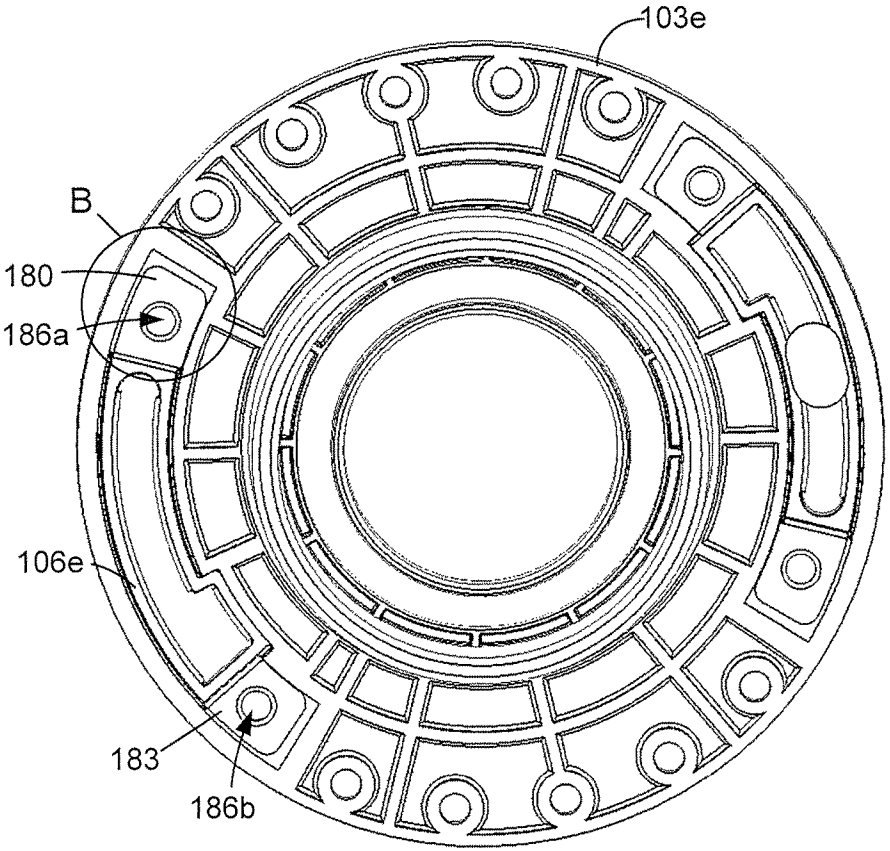
FIG. 7A illustrates a bottom side view of an alternative water closet flange with a pressed-in insert attached according to one embodiment described herein.

Turning to FIG. 7A, shown is a bottom side view of an alternative water closet flange embodiment with a pressed-in insert attached. In particular, FIG. 7A depicts a water closet flange 103*e* with an insert 106*e* attached within a recessed area of the water closet flange 103*e*.

The insert 106*e* has a first end 180 and a second end 183. The first end 180 can have a tab aperture 186*a*, and the second end 183 can have a tab aperture 186*b* (collectively "tab apertures 186"). FIG. 7A depicts a "B" reference for an enlarged view in FIG. 7B. Further, FIG. 7B illustrates that the insert 106*e* is truncated in comparison to previous discussed embodiments. For instance, the illustrated embodiment does not include clips. In some embodiments, a recessed step and the tab apertures 186 can be omitted in the insert 106*e*. In this embodiment, the insert 106*e* can be configured to have dimensions that are slightly less than a perimeter of the recess area in the water closet flange 103*e*.

Referring between FIGS. 7A and 7B, the insert 106*e* can be inserted within the recessed area of the bottom side of the water closet flange 103*e*, similar to other embodiments discussed above. During the insertion, the insert 106*e* can be positioned to align the tab aperture 186 with the insert apertures, similar to previously discussed embodiments. Subsequently, the insert 106*e* can be pressed into the recessed area of the water closet flange 103*e*. The insert 106*e* can be attached via the friction with the perimeter of the recessed area of the water closet flange 103*e*. Since the insert 106*e* has dimensions slightly less than the perimeter of the recessed areas of the water closet flange 103*e*, the perimeter of the insert 106*e* can be in contact with the perimeter of the recessed area of the water closet flange 103*e*. The contact can cause a friction, or a physical resistance, that keeps the insert 106*e* in the recessed area of the water closet flange 103*e*.

In addition, there are additional methods for attaching the insert 106 to the water closet flange 103. For example, the insert 106 can be attached to the water closet flange using an adhesive such as ultraviolet light curable cement.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An insert for a water closet flange, comprising:

an elevated arcuate portion that extends from a first end to a second end, the elevated arcuate portion comprising an arcuate keyhole aperture through the insert, the arcuate keyhole aperture having an eyelet end and a narrowed length;

a first recessed portion that extends away from the first end of the elevated arcuate portion and below a plane associated with the arcuate keyhole aperture, and a second recessed portion that extends away from the second end of the elevated arcuate portion and below the plane associated with the arcuate keyhole aperture;

a first clip integral with the insert that extends substantially perpendicular to the plane associated with the arcuate keyhole aperture, the first clip extending from the first recessed portion beyond the elevated arcuate portion; and a second clip integral with the insert that extends substantially perpendicular to the plane associated with the arcuate keyhole aperture, the second clip extending from the second recessed portion beyond the elevated arcuate portion.

2. The insert of claim 1, wherein the first clip and the second clip are configured to attach the insert to a bottom side of the water closet flange.

3. The insert of claim 1, wherein the first clip comprises two spaced-apart segments extending from the first recessed portion, each spaced-apart segment comprising a detent tooth at a distal end away from the first recessed portion.

4. The insert of claim 3, wherein the detent tooth comprises a first detent tooth, and wherein the first detent tooth of the insert is connected to a second detent tooth of the water closet flange positioned on a bottom side of the water closet flange.

5. The insert of claim 1, wherein the first clip comprises a U-shape configuration of two spaced-apart segments.

6. The insert of claim 1, wherein, when attached to the water closet flange, the arcuate keyhole aperture is substantially aligned with a flange arcuate aperture associated with the water closet flange, wherein a bolt is inserted through the eyelet end and moved to the narrowed length, the bolt comprising a base with a diameter larger than a width of the narrowed length of the arcuate keyhole aperture.

7. The insert of claim 6, wherein the bolt is inserted through the arcuate keyhole aperture and the flange arcuate aperture associated with the water closet flange.

8. The insert of claim 1, wherein the insert is comprised of at least one of solid steel, a metal, a polymer, or a plastic.

9. The insert of claim 1, wherein the elevated arcuate portion further comprises a raised edge positioned along at least a portion of a perimeter of the narrowed length of the arcuate keyhole aperture.

10. The insert of claim 1, wherein the elevated arcuate portion further comprises a lowered edge positioned along at least a portion of a perimeter of the elevated arcuate portion.

11. An apparatus, comprising:

a water closet flange comprising a flange arcuate aperture;

an insert comprising:

an elevated arcuate portion that extends from a first end to a second end, the elevated arcuate portion comprising an arcuate keyhole aperture through the insert, the arcuate keyhole aperture having an eyelet and a narrowed length;

a first recessed portion that extends away from the first end of the elevated arcuate portion, and a second recessed portion that extends away from the second end of the elevated arcuate portion; and wherein the insert is attached to a bottom side of the water closet flange, wherein, when attached, the flange arcuate aperture substantially aligns with the arcuate keyhole aperture.

12. The apparatus of claim 11, further comprising:

a first clip integral with the insert that extends substantially perpendicular to a plane associated with the arcuate keyhole aperture; and a second clip integral with the insert that extends substantially perpendicular to the plane associated with the arcuate keyhole aperture.

13. The apparatus of claim 12, wherein the first clip is attached via a first slot of the water closet flange and the second clip is attached via the first slot of the water closet flange.

14. The apparatus of claim 11, wherein the water closet flange comprises a recessed area surrounding the flange arcuate aperture on the bottom side of the water closet flange, wherein the insert fits within the recessed area.

15. The apparatus of claim 11, wherein a bolt is inserted through the eyelet and extended through the flange arcuate aperture, the bolt being moved toward the narrowed length of the arcuate keyhole aperture, wherein a base of the bolt prevents the bolt from passing through the narrowed length.

16. An insert apparatus for a water closet flange, comprising:

an elevated arcuate portion that extends from a first end to a second end, the elevated arcuate portion comprising an arcuate keyhole aperture through the insert apparatus, the arcuate keyhole aperture having an eyelet end and a narrowed length, wherein the elevated arcuate portion further comprises a lowered edge positioned along at least a portion of a perimeter of the elevated arcuate portion;

a raised edge positioned along at least a portion of a perimeter of the narrowed length of the arcuate keyhole aperture; and a first recessed portion that extends away from the first end of the elevated arcuate portion and a second recessed step that extends away from the second end of the elevated portion.

17. The insert apparatus of claim 16, further comprising:

a first clip integral with the insert apparatus extends substantially perpendicular to a plane associated with the arcuate keyhole aperture; and a second clip integral with the insert apparatus extends substantially perpendicular to the plane associated with the arcuate keyhole aperture.

18. The insert apparatus of claim 17, wherein the first clip and the second clip comprise two spaced-apart segments extending from the first recessed portion, each spaced-apart segment comprising a detent tooth at a distal end away from the first recessed portion.

19. The insert apparatus of claim 17, wherein the first clip comprises a U-shape configuration of two spaced-apart segments.

* * * * *